US005914743A

United States Patent [19]

Tagashira et al.

[11] Patent Number: 5,914,743

[45] **Date of Patent: *Jun. 22, 1999**

[54] THERMAL HEAD

[75] Inventors: Fumiaki Tagashira; Hideya Akasaka, both of Kyoto, Japan

[73] Assignee: Rohm Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/752,966

[22] Filed: Dec. 2, 1996

Related U.S. Application Data

[63] Continuation of application No. 08/264,145, Jun. 22, 1994, abandoned.

[30] Foreign Application Priority Data

Jul. 9, 1993 [JP] Japan ..... 5-170403

[51] Int. Cl.[6] ..... B41J 2/345

[52] U.S. Cl. ..... 347/208

[58] Field of Search ..... 347/208, 200

[56] References Cited

U.S. PATENT DOCUMENTS 5,367,321 11/1994 Shigenori et al. ..... 346/76 PH

FOREIGN PATENT DOCUMENTS

A 0 410 486
A1 1/1991 European Pat. Off. .
A 0 512 251
A1 11/1992 European Pat. Off. .
A 0 535 557
A1 4/1993 European Pat. Off. .
62-42860 8/1985 Japan .
2-72967 3/1990 Japan .
4-290756 10/1992 Japan ..... 347/208
5-309859 11/1993 Japan ..... 347/208
6-079895 3/1994 Japan ..... 347/208

OTHER PUBLICATIONS

Catalog, Rohm Co., Ltd., "Thermal Print Heads for Wide Size Plotters.", No. 3280 (3 pages).

*Primary Examiner*—Huan Tran
*Attorney, Agent, or Firm*—Fish & Richardson P.C.

[57] ABSTRACT

In a thermal head consisting of one or more substrates, each of the substrates comprises a heating element, common electrodes arranged on one of the sides of the heating element, and individual electrodes arranged on the other side of the heating element. In the vicinity of the side edges of the substrate, the patterns of the two types of electrodes extend from the heating element toward the upper edge and lower edge of the substrate corresponding to the top side and bottom side of the trapezoid, respectively, in such a manner as to be directed at an angle toward the central portion of the substrate. This enables a plurality of substrates to be manufactured with the same electrode patterns, and all the substrates to have the same data transfer direction to simplify the wiring.

8 Claims, 8 Drawing Sheets

THERMAL HEAD

This application is a continuation of U.S. application Ser. No. 08/264,145, filed Jun. 22, 1994, now abandoned.

BACKGROUND OF THE INVENTION

1. Field of the Invention

The present invention relates to a structure of a thermal head applicable to output terminals such as printers, plotters, facsimiles and, more particularly, to patterns of electrodes for supplying heating signals to heating elements juxtaposed on a substrate.

2. Description of the Related Arts

A typical thermal head consists of a single relatively small-sized substrate having thereon a heating element, common electrodes, and individual electrodes. Through the electrodes, the heating element is supplied with electrical power to generate heat. Thermal paper or ink film is brought into contact with the heating element by way of a protective film.

On the contrary, there is a recently increasing demand for a large-sized thermal head for use in the output terminals such as a CAD system. The large-sized thermal head is preferably composed of a single thermal head substrate. In this case, however, the heating elements or electrodes free from any defect must be formed over a large area of the substrate. The manufacture of such large-sized substrate will therefore face a large technical difficulty, which is not practical.

In the prior art, therefore, a plurality of small-sized substrates were arranged to constitute a large-sized thermal head, as disclosed in Japanese Patent Laid-open Pub. No. 2-72967.

This will be described in detail with reference to FIGS. 1 and 2. FIG. 1 shows, by way of example, a single thermal head consisting of three transversely alternately arranged substrates including substrates 10*a* and 10*c* having, in plan view, a substantially trapezoidal shape, and a substrate 10*b* having an inverted trapezoidal shape. FIG. 2 is an enlarged view of the thermal head depicted in FIG. 1.

On the substrates 10*a*, 10*b*, and 10*c*, alternately arranged are comb-teeth-like common electrodes 12 and also comb-teeth-like individual electrodes 14 on which a belt-like heating element 16 extends. The heat is generated in the region of the heating element 16 intervening between the common electrodes 12 and the individual electrodes 14 adjoining to each other.

The edges of the substrates 10*a*, 10*c* and the substrate 10*b* adjoining to each other correspond to the oblique sides of the trapezoid of each substrate. The edges of the substrates 10*a*, 10*c* and 10*b* (hereinafter, referred to as side edge portions of the substrate) are formed at predetermined angles θ3 and θ3' making supplementary angles other than 90 degrees. Moreover, the substrates 10*a* and 10*c* are displaced from the substrate 10*b* by a distance L with respect to the paper feed direction to thereby prevent the heating element 16 from being discontinuous between the adjacent substrates.

At the right and left side edge portions of the substrate, the electrodes 12 and the individual electrodes 14 are both disposed to form a predetermined angle θ5' in a counter-clockwise direction or a predetermined angle θ5 with respect to the direction orthogonal to the longitudinal direction of the substrate on which the heating element 16 is arranged. The angles of the electrode patterns θ5' and θ5 are substantially equal to the angles θ3' and θ3 of the side edge portions of the substrates so that the electrodes can be disposed for printing even at the side edge portions of the substrate having, in plan view, a substantially trapezoidal shape or an inverted trapezoidal shape.

In the case where a single thermal head is constituted of three alternately arranged substrates 10*a*, 10*b*, and 10*c* of a substantially trapezoidal shape or inverted trapezoidal shape having electrode patterns as shown in FIGS. 1 and 2, there is the inconvenience that at least two types of electrode patterns are required, that is, one for the trapezoidal substrates 10*a* and 10*c*, and the other for the inverted trapezoidal substrate 10*b*.

To this end, at least two systems of photo masks are needed for manufacturing three substrates to constitute a single thermal head, which will lead to increased development cost and development time. Furthermore, producing, cutting and assembling steps are necessary for two types of substrates, which will add to the number of steps.

Providing that a thermal head including a combination of two types of substrate having a trapezoidal shape and an inverted trapezoidal shape is formed with only one electrode pattern as in the substrates 10*a* and 10*c*, the positions where the common electrodes 12 are arranged on the substrates 10*a* and 10*c* will be where the paper arrives earlier than the heating element 16 with respect to the paper feed direction F, while the positions of the common electrodes 12 to be arranged on the substrate 10*b* will be where paper arrives later than the heating element 16, as shown in FIG. 3.

Therefore, when these substrates are employed to constitute a single thermal head, the positions of the common electrodes 12 and the individual electrodes 14 to be arranged with respect to the paper feed direction F will differ for each of the adjacent substrates and hence the direction of the data transfer will differ for each of the substrates, which results in complicated wiring and a complicated structure of the thermal head.

SUMMARY OF THE INVENTION

The present invention was conceived to solve the above problems, and the object of this invention is to provide a thermal head capable of being constituted of a plurality of substrates with the same electrode patterns irrespective of the shape of the substrates and having the same data transfer direction for all the substrates, so that it is possible to simplify the wiring.

In order to accomplish the above object, a thermal head in accordance with the present invention is characterized by the following.

In a thermal head comprising at least one or more substrates arranged in a transverse row and each having in plan view a substantially trapezoidal shape, each of the substrates comprises a heating element formed on the substrate in a belt or in a row along the longitudinal direction of the substrate, a plurality of common electrodes mainly arranged on one side along the longitudinal direction of the heating element, and a plurality of individual electrodes mainly arranged on the other side of the heating element.

The two types of electrodes positioned in the vicinity of the edges of the substrate corresponding to the oblique sides of the trapezoid extend from the heating element toward the edges of the substrate corresponding to the top side or bottom side of the trapezoid in such a manner as to be directed at an angle toward the central portion of the substrate.

The electrode patterns of the common electrodes and the individual electrodes are substantially orthogonal to the longitudinal direction of the heating element at the central portion of the substrate. The angle of the two types of electrodes diminishes accordingly as it approaches the central portion of the substrate from the edges of the substrate corresponding to the oblique sides of the trapezoid.

The common electrodes and the individual electrodes are alternately arranged at the portion where the heating element is formed.

The common electrodes and the individual electrodes confront each other at the portion where the heating element is formed.

The edges of the substrate corresponding to the oblique sides of the trapezoid are formed at angles making supplementary angles other than 90 degrees with the edges of another substrate adjoining to the substrate.

The angles of the edges of the substrate corresponding to the oblique sides of the trapezoid with respect to the longitudinal direction of the substrate are substantially equal to the angles of one of the two types of electrodes disposed on the edges of the substrate with respect to the longitudinal direction.

Heating regions of the heating element formed in the vicinity of the edges of the substrate corresponding to the oblique sides of the trapezoid present the configuration resembling a sign of inequality "<" or ">".

The heating regions of the heating element formed at the central portion of the substrate present the configuration resembling a quadrangle.

According to the present invention, the common electrodes are disposed at predetermined angles with respect to the direction orthogonal to the longitudinal direction of the heating element while the individual electrodes are disposed at predetermined angles in the opposite direction to that of the common electrodes in such a manner that the electrode patterns of the common electrodes and the individual electrodes on the substrate extend from the heating element toward the edges of the substrate corresponding to the top and bottom sides of the trapezoid (referred to as upper and lower edges of the substrate) so as to be angled toward the central portion of the substrate in the vicinity of the edges of the substrate corresponding to the oblique sides of the trapezoid (referred to as side edges of the substrate).

Thus, the common electrodes and the individual electrodes bend around the heating element to present the configuration of a mathematical sign of inequality "<" at the left edge portion of a substrate cut into a desired shape such as a trapezoid or an inverted trapezoid while presenting the configuration of a mathematical sign of inequality ">" at the right edge portion of the substrate.

In the case where a single thermal head is comprised of a plurality of substrates having a substantially trapezoidal or inverted trapezoidal shape, such electrode patterns would eliminate the need to change the electrode patterns of the substrates depending on the positions, such as to the left, the center, or the right of the thermal head, where the substrates are arranged.

The substrates are generally manufactured by separately cutting a plurality of regions previously formed on an insulated substrate and each comprising a substrate. Therefore, if the same electrode patterns are applicable to all the substrates, as in the present invention, the same photo mask can be used to reduce the number of manufacturing steps.

Even though a plurality of substrates having a trapezoidal or inverted trapezoidal shape are combined to comprise a single thermal head, the positions where the electrodes are arranged with respect to the paper feed direction will not differ for each of the substrates, thus allowing the print data to be transferred in the same direction. It is therefore not necessary to arrange additional wiring, ensuring the manufacture of thermal heads with a simple structure while keeping a good printing quality.

DESCRIPTION OF THE PREFERRED EMBODIMENTS

Embodiments of the present invention will now be described with reference to the accompanying drawings.

Embodiment 1

Figure 1:
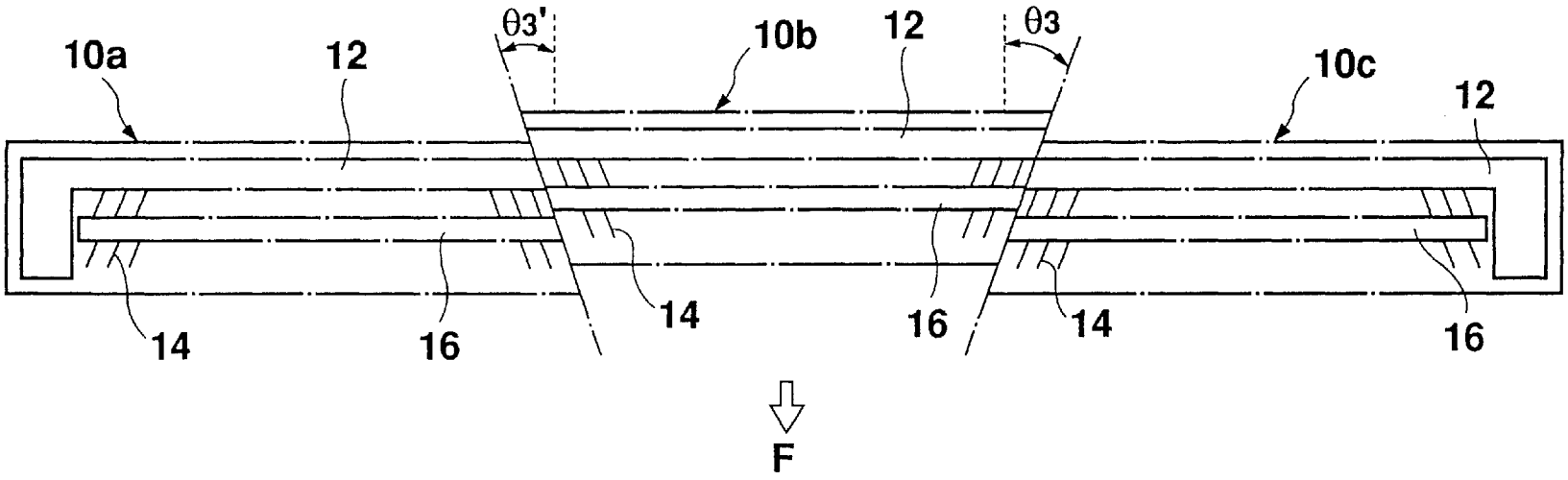
Fig. 1 PRIOR ART
FIG. 1 is a structural diagram depicting the entirety of a conventional thermal head.
Figure 2:
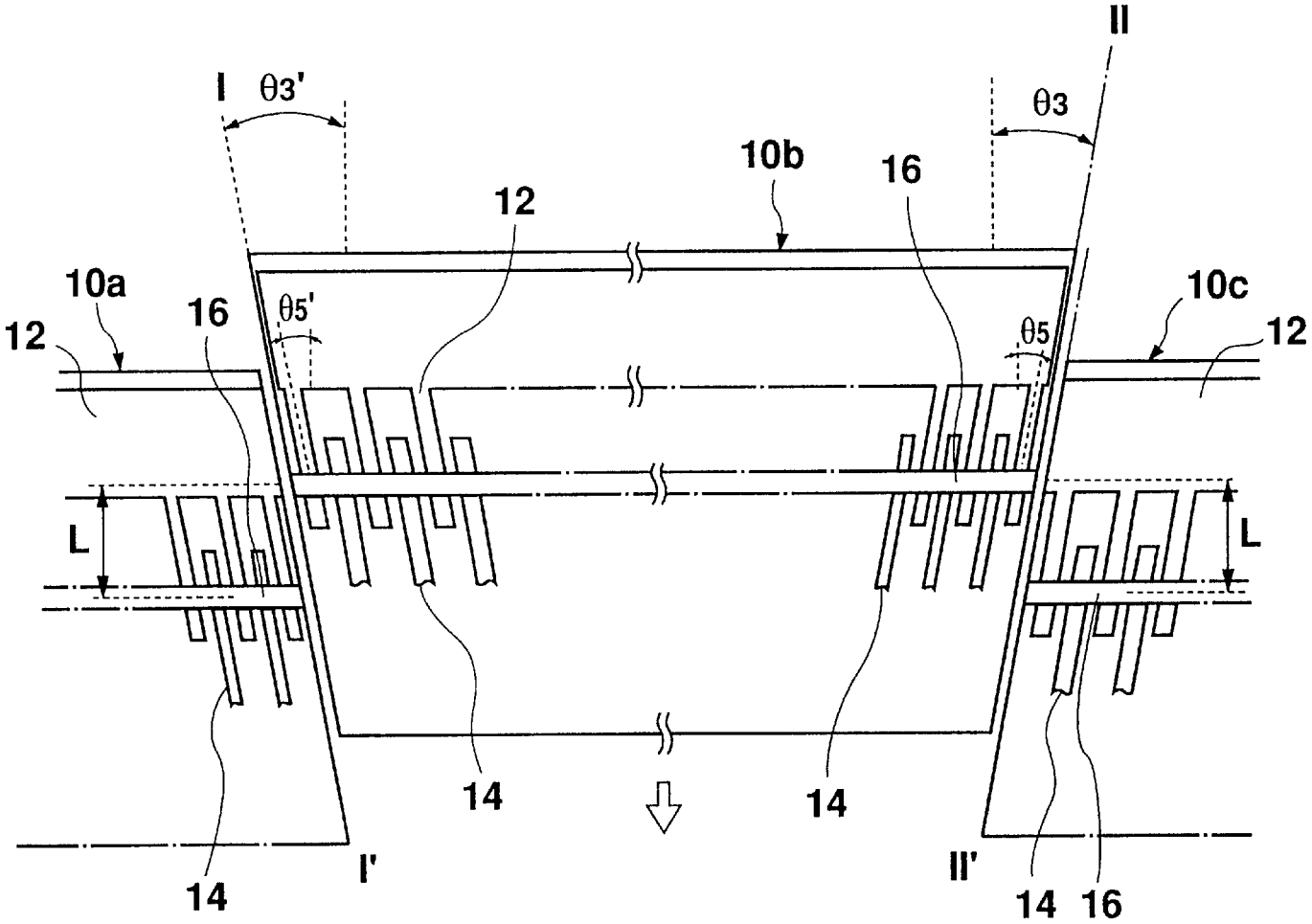
Fig. 2 PRIOR ART
FIG. 2 is an enlarged view showing the major part of the thermal head in FIG. 1.
Figure 3:
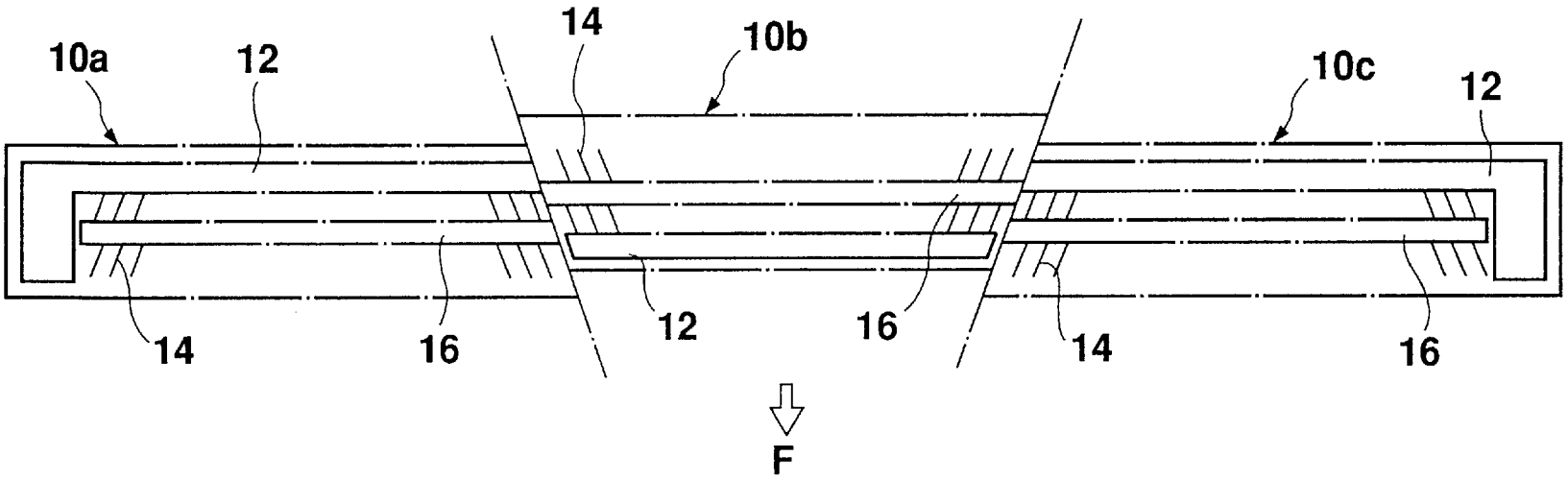
Fig. 3 RELATED ART
FIG. 3 is a structural diagram depicting the entirety of another thermal head in the related art.
Figure 4:
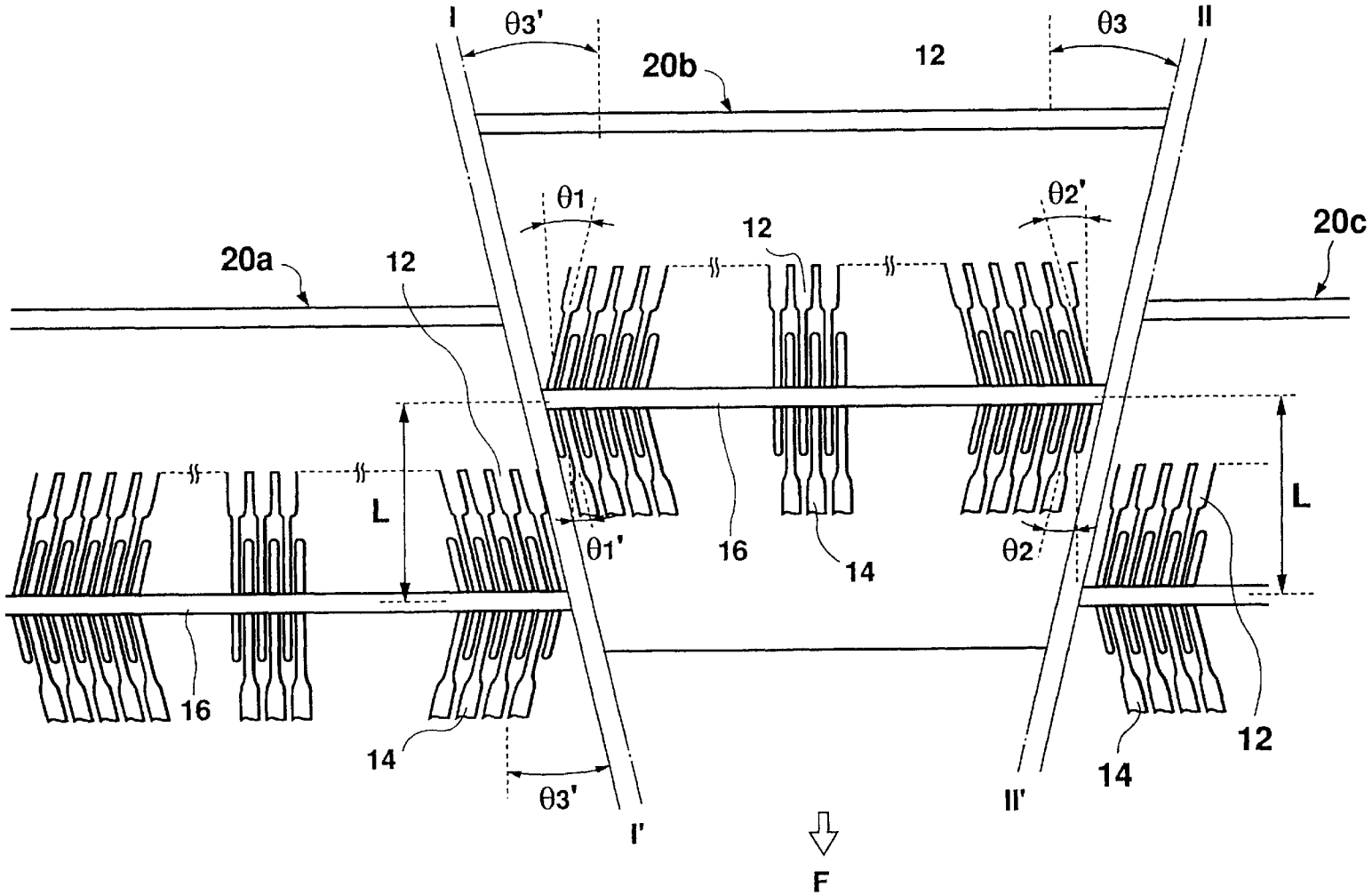
FIG. 4 is a structural diagram showing the major part of a thermal head in accordance with an embodiment of the present invention.

FIG. 4 is a diagram depicting the constitution of a thermal head embodying the present invention, in which parts identical to those of thermal heads shown in FIGS. 1 and 2 are designated by the same reference numerals.

In FIG. 4, substrates 20*a* and 20*c* each having a generally trapezoidal shape in plan view and a substrate 20*b* having an inverted trapezoidal shape are transversely and alternately arranged in the direction orthogonal to the paper feed direction F so as to constitute a single thermal head.

On the substrates 20*a*, 20*b*, and 20*c* are belt-like heating elements 16 extending along the long sides of the substrates and in the direction substantially orthogonal to the paper feed direction F. Comb-teeth-shaped common electrodes 12 and individual electrodes 14 are disposed in an alternate manner with respect to the heating elements 16.

The heating elements 16 are discontinuous among the substrates 20*a*, 20*b*, and 20*c*. In order to prevent the deterioration of the printing quality, the side edge portions (lines I–I' and II–II' in the figure) of the substrates form predetermined angles θ3' and θ3 with respect to the paper feed direction F. More specifically, the side edge portions of a substrate adjacent to the other substrates are cut to form supplementary angles other than 90° with respect to one another. The trapezoidal substrates 20*a* and 20*c* are arranged relative to the inverted trapezoidal substrates 20*b* in such a manner that their respective heating elements 16 are displaced from each other by a length L.

A specific constitution of the electrode patterns, by way of example, of the inverted trapezoidal substrate 20*b* will be described hereinbelow. It will be noted that the electrode patterns of the other trapezoidal substrates 20*a* and 20*c* are basically the same as that of the substrate 20*b*. The common electrodes 12 and the individual electrodes 14 provided in the vicinity of the side edge portions of the substrate 20*b* extend from the heating elements 16 toward the upper and lower end portions (which correspond to the upper and lower sides of the trapezoid) in such a manner that they are angled toward the central portion of the substrate 20*b*. More specifically, the common electrodes 12 disposed at the left end on one side of the heating element 16 of the substrate 20*b* form a predetermined angle θ1 in a clockwise direction with respect to the direction orthogonal to the long sides of the heating element 16, while the common electrodes 12 disposed at the right end form an angle θ2' in a counterclockwise direction. These angles θ1 and θ2' diminish accordingly as approaching the center of the substrate 20*b* and become substantially zero at the center of the substrate 20*b*.

Although the angles θ1 and θ2' are to be changed for each of the electrodes in this embodiment, the change may be made collectively for a plurality of electrodes.

In contrast with the common electrodes 12, the individual electrodes 14 disposed at the left end on the other side of the substrate 20*b* form a predetermined angle θ1' in the counterclockwise direction with respect to the direction orthogonal to the long sides of the heating element 16 while the individual electrodes 14 disposed at the right end form an angle θ2 in a clockwise direction. These angles θ1' and θ2 diminish accordingly as the center of the substrate 20*b* is approached, and become substantially zero at the center of the substrate 20*b*. The amount of change was set to be Δθ for each of the electrodes in the same manner as the amount of the change in the pattern of the common electrodes 12.

The angles of the electrode patterns in this embodiment can be $|\theta 1|=|\theta 2'|=|\theta 1'|=|\theta 2|$ or $|\theta 1|=|\theta 2|$, $|\theta 1'|=|\theta 2'|$. The values of the angles θ3 and θ3' of lines I–I' and II–II', respectively, with respect to the paper feed direction F can be θ3'=θ1', θ3=θ2, respectively. As a result, the electrode patterns will present the configuration of a mathematical sign of inequality "<" at the left end of the substrate cut into a desired shape, and the configuration of a sign of inequality ">" at the right end thereof. It is to be appreciated that these angles θ1, θ1', θ2, θ2', θ3, θ3' do not necessarily need to be equal. These angles may have such predetermined magnitudes in the substrate cut into a desired shape such as a trapezoid or an inverted trapezoid that the electrode patterns of the common electrode and the individual electrodes can be angled toward the central portion of the substrate in the vicinity of the side edge portions of the substrate while extending from the heating element toward the upper and lower ends of the substrate.

The magnitudes of the angles θ1, θ1', θ2, θ2' in these electrode patterns can be set to desired values depending on the amount of change Δθ for each electrode or for a plurality of electrodes and the print dot density of the thermal head.

Figure 5:
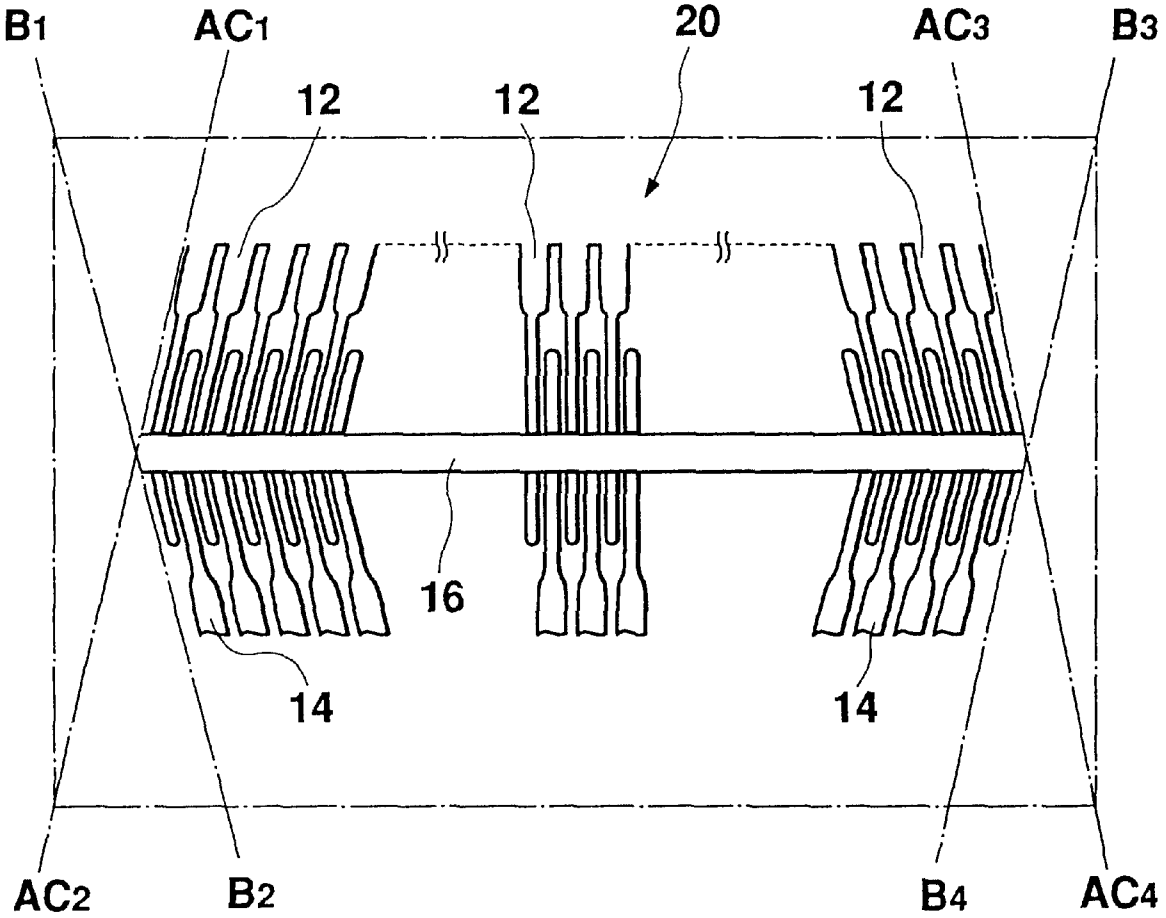
FIG. 5 is a diagram for explaining cutting planes, in the process of manufacturing, of a substrate in accordance with the present invention.

In manufacturing a substrate of trapezoidal shape or inverted trapezoidal shape having such electrode patterns, the heating element 16, common electrodes 12 and individual electrodes 14 are formed in each region constituting each substrate 20 on an insulated substrate (not shown) made of, e.g., alumina ceramic, as illustrated in FIG. 5. The insulated substrate is then cut along the line AC1–AC2 or AC3–AC4 in the diagram to obtain a substrate 20*c* or 20*a*, respectively, having the trapezoidal shape shown in FIG. 4. A substrate 20*b* having the inverted trapezoidal shape in FIG. 4 is obtained by cutting the insulated substrate along the line B1–B2 and B3–B4.

Figure 6:
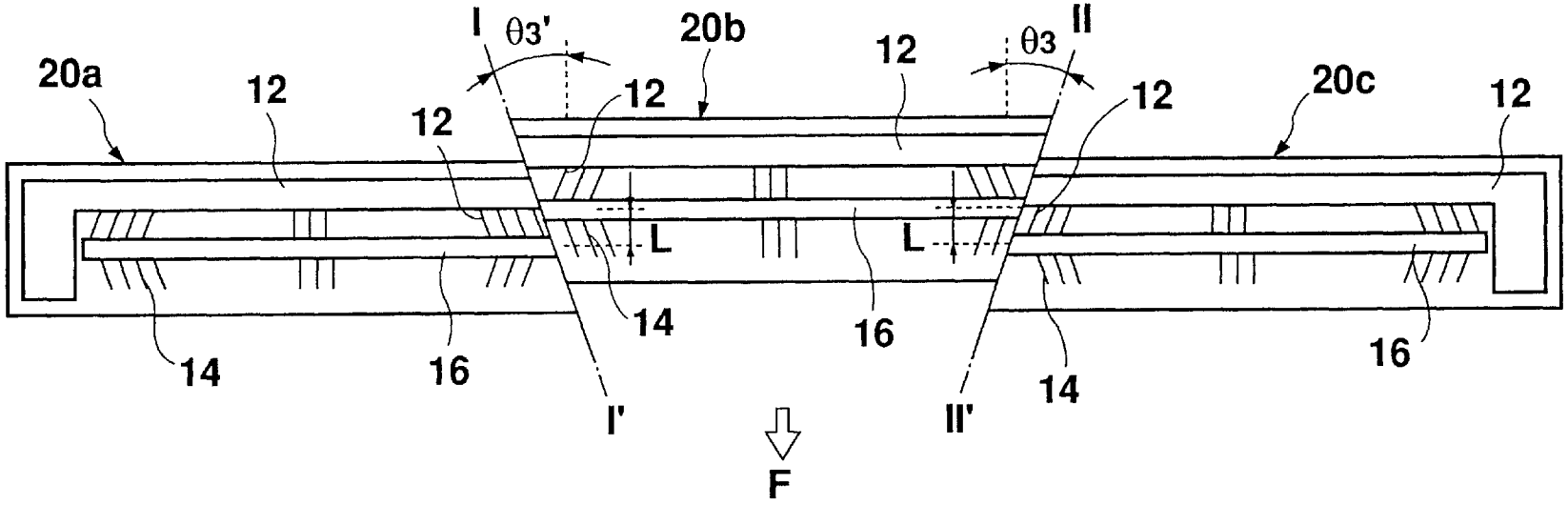
FIG. 6 is a structural diagram depicting the entirety of a thermal head in accordance with an embodiment of the present invention.

Thus, in the case of using the substrates 10*a*, 20*b*, and 20*c* in FIG. 4 to constitute a single thermal head as depicted in FIG. 6, the same electrode patterns can be employed for the substrates 20*a*, 20*b*, and 20*c* having substantially trapezoidal or inverted trapezoidal shape in top plan view, thereby enabling the manufacture of the substrates by use of only one photo mask in the production process.

Furthermore, the positions where the electrodes are arranged with respect to the paper feed direction do not differ depending on the substrates 20 having the trapezoidal or inverted trapezoidal shape, thus ensuring the same transfer direction of the print data and eliminating the need for additional wiring even though a plurality of substrates 20 are transversely arranged to constitute a single thermal head.

In order to obtain the same effect as the present embodiment, the shape of the substrate 20 formed by cutting the insulated substrate is not limited to the trapezoid or inverted trapezoid as long as the side edge portions adjacent to the other substrates 20 form a predetermined angle with respect to the paper feed direction.

Figure 7:
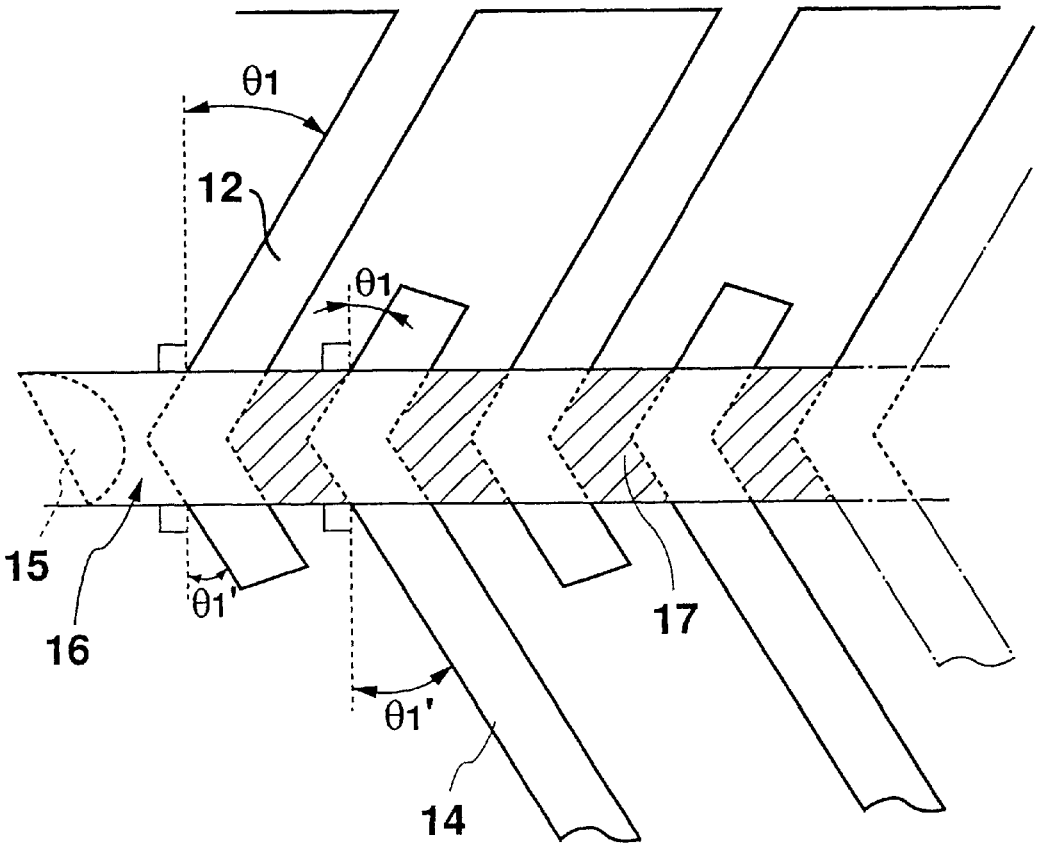
FIG. 7 is an enlarged top plan view showing the left end of a substrate 20 in FIG. 5.

FIG. 7 is an enlarged top plan view of the heating element 16 and its vicinity at the left end of the substrate 20 shown in FIG. 5.

Comb-teeth-like common electrodes 12 and individual electrodes 14 are alternately arranged on the substrate, and a resistor layer 15 is superposed on the two types of electrodes. A hatched area 17 designates a heating region in the resistor layer 15 which generates heat by the individual electrodes 14 and the common electrodes adjoining thereto. In this embodiment, the belt-like heating element 16 consists of a plurality of aligned heating regions 17. Actually, an insulated protective film not shown herein is further superposed thereon so as to cover the whole of the substrate.

The electrode patterns are so formed that the common electrodes 12 and individual electrodes 14 located near the side edge portions of the substrate and extending from the heating element 16 toward the upper and lower ends of the substrate are angled toward the central portion of the substrate.

More specifically, the common electrodes 12 disposed on one side of the heating element 16 form a predetermined angle in a clockwise direction with respect to the direction orthogonal to the long sides of the heating element 16, whereas the parts of the common electrodes 12 extending from the other side of the heating element 16 form an angle θ1' in a counterclockwise direction. On the contrary, the individual electrodes 14 disposed on the other side of the heating element 16 form an angle θ1' in a counterclockwise direction, whereas the parts of the individual electrodes 14 extending from the one side of the heating element on which the common electrodes are mounted form a predetermined angle θ1 in a clockwise direction.

Therefore, at the left end of the substrate being cut into a desired shape such as trapezoid or inverted trapezoid, the electrode patterns of the common electrodes 12 and the individual electrodes 14 have the configuration of the sign of inequality "<".

On the other hand, at the right end not shown of the substrate, the common electrodes 12 disposed on the one side of the heating element 16 form a predetermined angle θ1' in a counterclockwise direction with respect to the direction orthogonal to the long sides of the heating element 16, whereas the parts of the common electrodes 12 extending from the other side of the heating element 16 form a predetermined angle θ2 in a clockwise direction. On the contrary, the individual electrodes 14 disposed on the other side of the heating element 16 form a predetermined angle θ2 in a clockwise direction whereas the parts of the individual electrodes 14 extending from the one side of the heating element 16 on which the common electrodes 12 are arranged to form a predetermined angle θ2' in counterclockwise direction.

Therefore, at the right end of the substrate, the electrode patterns of the common electrodes 12 and the individual electrodes 14 present a configuration of the sign of inequality ">".

Correspondingly, at the left end of the substrate the heating regions 17 substantially have a configuration of the sign of inequality "<" as shown in FIG. 4, while at the right end not shown of the substrate the heating regions 17 substantially have a configuration of the sign of inequality ">".

At the central portion of the substrate, the common electrodes 12 and the individual electrodes 14 alternately disposed along the heating element 16 are substantially orthogonal to the heating element 16. As a result, at the central portion of the substrate, the heating regions 17 exhibit a configuration of a quadrangle.

The heating regions 17 in this embodiment have different configurations and areas between the side edge portions of the substrate and the central portion of the substrate. However, the angle of the electrode patterns with respect to the heating element 16 comes near to a right angle accordingly as the central portion of the substrate is approached so that there is very little difference in configuration and area between two heating regions 17 adjacent to each other. Moreover, the areas of the heating regions 17 are not so large, compared with the resolution of the human eye. Accordingly, the above will not cause any practical problems in printing.

In the case of using a plurality of substrates to constitute a single thermal head as shown in FIG. 6, as described hereinbefore, the constitution of this embodiment allows the plurality of substrates to be constituted with the same electrode patterns.

Since the positions of the electrodes arranged with respect to the paper feed direction do not differ among the substrates having a trapezoidal shape and an inverted trapezoidal shape, the thermal head consisting of a plurality of substrates allows print data to be transferred in the same direction, which will eliminate the necessity of arranging additional wiring.

Embodiment 2

Figure 8:
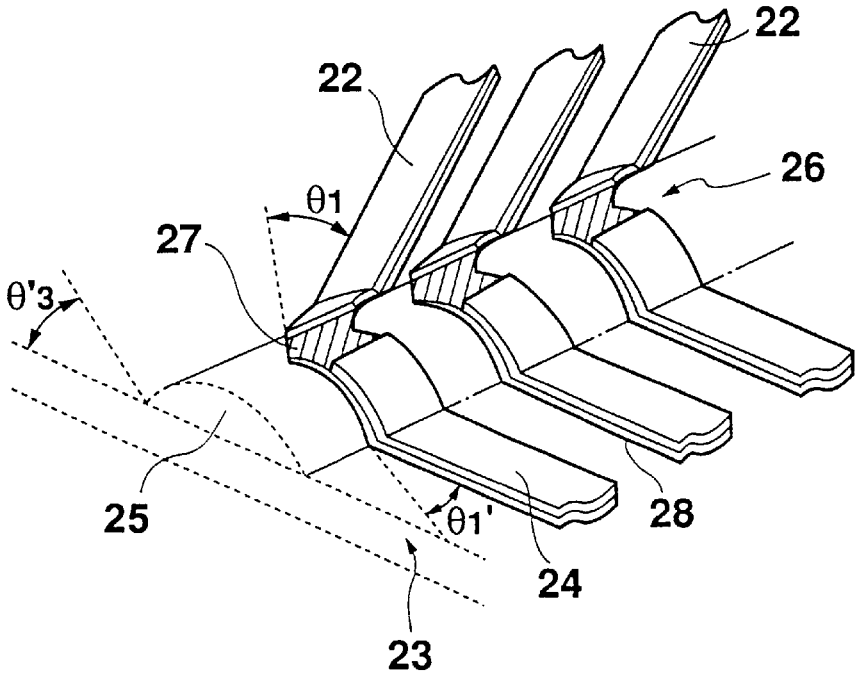
FIG. 8 is an enlarged perspective view showing the left end of a substrate in accordance with another embodiment of the present invention.

Referring to FIG. 8, another embodiment of the present invention will be described.

FIG. 8 is an enlarged perspective view showing the left end of a substrate in the case of using a thermal head element different from the first embodiment.

On an insulated substrate 23 made of, e.g., alumina ceramic, a belt-like glazed layer 25 is formed which is spanned with resistor layers 28 and then common electrodes 22 and individual electrodes 24 are each superposed on the resistor layers 28. An insulated protective film not shown is actually laminated thereon so as to cover the entirety of the substrate.

The common electrodes 22 and the individual electrodes 24 are separated from each other and formed by selectively etching, on a part of the glazed layer, electrically conductive layers which have been formed on the resistor layers 28.

The portions of the resistor layers 28 exposed by etching (hatched portions in the figure) define heating regions 27 which are controlled by the common electrodes 22 and individual electrodes 24 confronting each other.

Assuming that a row of the heating regions 27 is a heating element 26, the common electrodes form a predetermined angle θ1 in a clockwise direction with respect to the direction orthogonal to the long side of the heating element 26, while the individual electrodes 22 are angled at θ1' in a counterclockwise direction. Consequently, the heating regions 27 will substantially present a configuration of the sign of inequality "<".

On the other hand, at the right end not shown of the substrate having in plan view a trapezoidal or inverted trapezoidal shape, the common electrodes 22 are disposed so as to form a predetermined angle θ2' in a counterclockwise direction with respect to the direction orthogonal to the heating element 26, while the individual electrodes 24 are angled at θ2 in a clockwise direction. Therefore, the heating regions 27 will present a configuration of the sign of inequality ">" which is contrary to FIG. 8.

Figure 9:
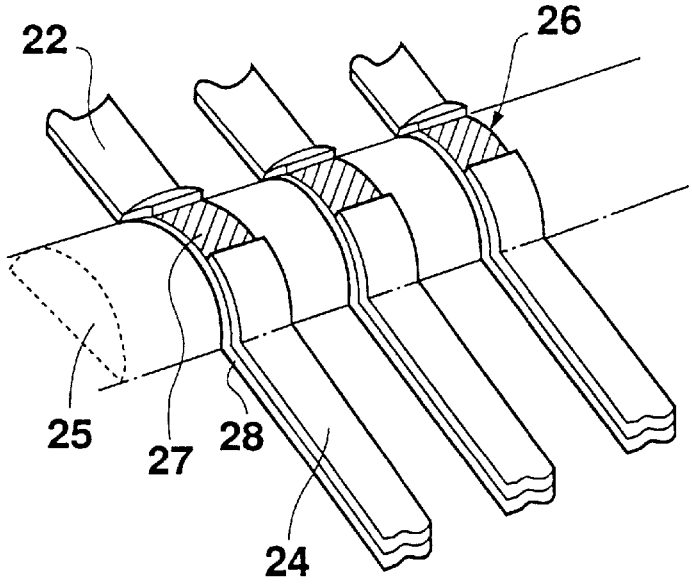
FIG. 9 is an enlarged perspective view showing the central portion of the substrate in FIG. 8.

FIG. 9 is an enlarged perspective view of the central portion of the substrate depicted in FIG. 8. Elements identical to those in FIG. 8 are designated by the same reference numerals, which will not be further described.

At the central portion of the substrate, the common electrodes 22 and the individual electrodes 24 confronting each other are arranged so as to form substantially right angles, respectively, with respect to the heating element 26 so that the heating regions can present a configuration of the quadrangle, without bending, on the glazed layer 25.

It is to be appreciated that the angles θ1, θ1', θ2, θ2' decrease accordingly as the center of the substrate is approached and results in nearly zero at the center of the substrate, and that the amount of change in angle is set at Δθ for each of the electrodes in this embodiment, which will not be limited to this in the same manner as the first embodiment.

As shown in FIGS. 8 and 9, the heating regions 27 in this embodiment have different configurations and areas between the side edge portions of the substrate and the central portion of the substrate. However, there is very little difference in configuration and area between the two heating regions 17 adjacent to each other. Moreover, the areas of the heating regions 17 are not so large, compared with the resolution of the human eye. Accordingly, the above will not cause any practical problems in printing.

In the case of using a plurality of substrates to constitute a single thermal head as shown in FIG. 6, as in the first embodiment described above, this embodiment will allow the plurality of substrates to be constituted with the same electrode patterns.

Since the positions of the electrodes arranged with respect to the paper feed direction do not differ among the substrates having a trapezoidal shape and an inverted trapezoidal shape, the thermal head consisting of a plurality of substrates allows print data to be transferred in the same direction, which will eliminate the necessity of arranging additional wiring.

Although a thermal head consisting of a plurality of substrates cut into desired shapes has been described in the first and second embodiment, the constitution of the present invention is also applicable to a thermal head consisting of a single substrate.

According to a thermal head having electrode patterns in accordance with the present invention, as described above, it is possible to form a plurality of substrates with the same electrode patterns when constituting a single thermal head by arranging the plurality of substrates.

It is also possible to provide a thermal head in which all substrates have the same data transfer direction to simplify the arrangement of wiring.

What is claimed is:

1. A thermal head comprising:

at least two substrates connected to one another in a longitudinal direction at a connecting line that is inclined by a non-zero inclination angle to a transverse direction perpendicular to the longitudinal direction, each substrate comprising:

a heating element formed along the longitudinal direction;

at least one common electrode that extends from the heating element by a first angle with respect to the heating element that is less than or equal to an acute angle formed by the connecting line and the longitudinal direction, the at least one common electrode being linear in shape; and at least one individual electrode that extends from the heating element by a second angle with respect to the heating element that is less than or equal to an acute angle formed by the connecting line and the longitudinal direction, the at least one individual electrode being linear in shape.

2. A thermal head according to claim 1, wherein said at least one common electrode and said at least one individual electrode are alternately arranged at a portion where said heating element is formed.

3. A thermal head according to claim 1, wherein said at least one common electrode and said at least one individual electrode confront each other at a portion where said heating element is formed.

4. A thermal head according to claim 1, wherein, with respect to the longitudinal direction, edges of a first substrate corresponding to oblique sides of a trapezoidal shape of the first substrate are formed at angles making supplementary angles other than 90 degrees with the edges of other substrates adjoining the first substrate.

5. A thermal head according to claim 4, wherein the angles of the edges of the first substrate are substantially equal to an angle of the at least one common electrode or the at least one individual electrode with respect to the longitudinal direction, the at least one common electrode or the at least one individual electrode being disposed at one of the edges of the first substrate.

6. A thermal head according to claim 1, wherein the heating element further comprises heating regions and wherein the heating regions formed at a central portion of the first substrate are formed in a configuration resembling a quadrangle.

7. A thermal head comprising:

at least two substrates connected to one another in a longitudinal direction of the thermal head at a connecting line that forms a non-zero inclination angle with respect to a transverse direction perpendicular to the longitudinal direction of the thermal head;

wherein for each of the substrates:

a heating element is formed on the substrate along the longitudinal direction of the thermal head;

at one side edge of the substrate in the longitudinal direction of the thermal head, a first electrode of either a common or an individual electrode type extends linearly from a first side of the heating element at a first angle that is less than 90° in a clockwise direction with respect to the transverse direction, and a second electrode of an opposite electrode type extends linearly from a second side of the heating element at a second angle that is less than 90° in a counterclockwise direction with respect to the transverse direction;

at an opposite side edge of the substrate in the longitudinal direction of the thermal head, a third electrode of a same electrode type as the first electrode extends linearly from the first side of the heating element at a third angle that is less than 90° in the counterclockwise direction with respect to the transverse direction, and a fourth electrode of a same electrode type as the second electrode extends linearly from the second side of the heating element at a fourth angle that is less than 90° in the clockwise direction with respect to the transverse direction; and absolute values of the first, second, third and fourth angles are less than or equal to an absolute value of the non-zero inclination angle of the connecting line.

8. The thermal head according to claim 7, wherein the substrates are displaced relative to one another by a predetermined amount in the transverse direction.

* * * * *